US005168241A

United States Patent [19]

Hirota et al.

[11] Patent Number: 5,168,241

[45] Date of Patent: Dec. 1, 1992

[54] ACCELERATION DEVICE FOR CHARGED PARTICLES

[75] Inventors: Junichi Hirota, Hitachi; Masatsugu Nishi, Katsuta, both of Japan

[73] Assignee: Hitachi, Ltd., Tokyo, Japan

[21] Appl. No.: 495,617

[22] Filed: Mar. 19, 1990

[30] Foreign Application Priority Data

Mar. 20, 1989 [JP] Japan ..... 1-66225

[51] Int. Cl.[5] ..... H05H 13/04

[52] U.S. Cl. ..... 328/233; 328/235; 333/231; 333/235

[58] Field of Search ..... 328/233, 235; 315/5.41, 315/5.42; 333/230, 231, 235

[56] References Cited

U.S. PATENT DOCUMENTS 3,043,986 7/1962 Podliusky ..... 328/233
4,794,340 12/1988 Ogasawara ..... 328/235
4,992,745 2/1991 Hirota et al. ..... 328/233

OTHER PUBLICATIONS

Fukushima et al; Characteristics of RF Accelerating Cavity, Feb. 18, 1975, Institute for Nuclear Study; pp. 1-25.

Evans et al; The 1 MV 114 MHz Electron Accelerating System For the CERN PS; Sep. 1987; pp. 1901-1903 IEEE.

*Primary Examiner*—Donald J. Yusko
*Assistant Examiner*—Michael Horabik
*Attorney, Agent, or Firm*—Antonelli, Terry Stout & Kraus

[57] ABSTRACT

An acceleration device for charged particles has an acceleration cavity through which passes a beam of the particles. High frequency power from a suitable source is transmitted to the cavity via a suitable transmission means (antenna) to transmit the energy to the particles and so accelerate them. The transmission means is controlled by a suitable control to control the coupling constant of the transmission means when power is applied. Also, the device may have a looped conductor in the cavity controlled by the control to couple to the field in the cavity and to extract power from the field, thereby to control the de-tuning of the applied power relative to the power transmitted to the particles. By controlling the coupling constant and/or the de-tuning, power may be transmitted efficiently to the beam of particles.

43 Claims, 8 Drawing Sheets

ACCELERATION DEVICE FOR CHARGED PARTICLES

BACKGROUND OF THE INVENTION

1. Field of the Invention

The present invention relates to an acceleration device for charged particles. It also relates to an accelerator system incorporating such a device.

2. Summary of the Prior Art

It is known to generate synchrotron radiation using a ring type accelerator as the synchrotron radiation generator. In a synchrotron accelerator or in a storage ring, a beam of charged particles is accelerated to a storage energy. In order to do that, particles at low energy are obtained, and injected into the ring for acceleration to high energy. When synchrotron radiation is needed for industrial purposes, it becomes important that the synchrotron radiation generator is relatively compact. Generally, an industrial synchrotron radiation generator has a linear accelerator which creates a beam of charged particles and accelerates it to a low energy level, a synchrotron which raises the low energy charged particle beam to a higher energy level, and an accumulation ring which accelerates the beam even further and accumulates the beam of charged particles.

As stated above, it is desirable that an industrial synchrotron radiation generator occupies a small area. This enables the generator to be installed in e.g. a semiconductor fabrication factory. A high brightness (i.e. large current) is also necessary to reduce the irradiation time. To meet the requirement of a small area it is, of course, necessary to make each unit element smaller. However, if by using only an accumulation ring, a charged particle beam can be synchrotron accelerated from a low energy level to a final energy level in a stable way, the synchrotron stage can be omitted and the size of the system reduced significantly.

A charged particle beam is accelerated with energy supplied from a high frequency power source through a high frequency (radio frequency) acceleration cavity. To achieve stable synchrotron acceleration of a charged particle beam with a high frequency acceleration cavity, synchrotron phase stability (hereinafter referred simply to as phase stability, which will be explained in more detail later) must be achieved. When a charged particle passes through a high frequency acceleration cavity, an electric field is created by this current, and with this electric field, a voltage is generated in opposite phase to the acceleration voltage which is generated from the high frequency power source (hereinafter this voltage in opposite phase is referred to as the voltage induced by the beam). As a result, the charged particles lose a part of the energy supplied and it becomes difficult to ensure the stability of the beam around the looped path. Thus, the charged particles cannot maintain a satisfactory phase stability. Such an effect becomes greater as the number of charged particles in the beam increases, i.e. as the beam current increases. Hereinafter, the gap between the oscillation frequency of the high frequency power source and the resonance frequency of the high frequency acceleration cavity will be referred to as the de-tune value, and the creation of such gap as detuning.

One method of synchrotron acceleration of charged particles is discussed in the study "Characteristics of a high frequency acceleration cavity" (INS-TH-96. Institute of Nuclear Study, Tokyo University, Feb. 18, 1975). This conventional technology adopts the method of maintaining a constant acceleration voltage to the charged particles by controlling the high frequency power only, which is the source of the power supply to the high frequency acceleration cavity.

A high frequency acceleration cavity is discussed in the IEEE Partial Accelerator Conference (1987) pp. 1901 to 1903. To change the resonance frequency, the high frequency acceleration cavity must be transmitted onto the magnetic body which consists of a tuner. The aforementioned conventional technology uses a method of capturing the high frequency magnetic field in a cavity then transmitting it by using a coaxial transmission line.

In the high frequency acceleration cavity discussed above, the capturing of the high frequency magnetic field was via a coaxial cable, and this method permitted only a small change in the detuning. In low current applications, this is not a problem, but it becomes so at higher current where the amount of detuning is greater.

SUMMARY OF THE INVENTION

The two known systems described above each have their own problems.

The problem of the first system is that it requires an unnecessarily high capacity, high frequency power source. The electric power from the high frequency power source is magnetically coupled and impressed in a high frequency acceleration cavity with a high frequency antenna. The coupling constant, which represents the degree of the coupling, depends on the energy of the charged particle and on the current. However, since the coupling constant is kept at a fixed value, if the energy varied over a wide range or if the current fluctuated, the system cannot respond properly. Therefore, the power from the high frequency power source cannot be effectively impressed into the high frequency acceleration cavity. In other words, a high frequency power source more than necessary is needed in order to supply the necessary electric power to the high frequency acceleration cavity in view of the application efficiency.

Also, the synchrotron acceleration at a large current is not always stable. As previously described, when a large current flows into the high frequency acceleration cavity, it reduces the energy supplied to the charged particles by the beam-induced voltage. Stable synchrotron acceleration will not be achieved simply by enhancing the capacity of the high frequency power source to compensate this reduced energy.

In the second system, the energy is transmitted through a coaxial transmission line, however, because of a great attenuation of the high frequency magnetic field strength on the coaxial transmission line, the detune value cannot be enhanced.

In order to overcome these problems, the present invention permits control of either or both of the coupling constant and the detuning. The latter is the relationship between the high frequency power input to the cavity and the accelerating power generated for transmission to the charged particles. The latter has already been discussed, and relates to the beam induced current. In order to control the coupling constant, it is possible to detect power which is reflected from the cavity. Such power represents the power which is not converted to acceleration power, and thus by controlling this, the coupling constant can be controlled. Prefereably, that control as such has to ensure that the reflect power is substantially zero. In order to transmit power to the cavity, the transmitting device should be magnetically coupled to the cavity, and there is a field/permeability relation controlling that coupling. The present invention proposes that that field strength/permeability relation be controlled to vary the magnetic coupling, and so vary the coupling constant. In order to do this, a bias is applied to the magnetic coupling of the transmitting means to the cavity, and a bias current to that control means is controlled. That bias preferably is performed by a magnetic body at a coil controlled by the bias current, so that a bias magnetic field is generated which acts on the means for transmitting the high frequency power to the cavity.

As mentioned above, the present invention may also include detuning control. In this case, the detuning control includes at least one looped conductor in the cavity which couples to the field in the cavity and extracts power from the field. Suitable means is provided for controlling that power extraction. It has been found that a looped conductor does not attenuate the power transmitted thereby, so that the problems of the prior art coaxial arrangement are no longer present, and control and detuning over a wide range can be achieved.

Preferably, the extraction of power is controlled by a magnetic body which effects the coupling of the looped conductor to the field, and a power source connected to that magnetic body is controlled so as to change the specific magnetic permeability of the body.

Suitable means may be provided for detecting the detuning of the acceleration power relative to the high frequency power, and the control in the detuning control means thereby. Alternatively, an automatic arrangement may be used.

It has also been found that the coupling constant controller arrangement discussed above, if connected to the cavity, will also at least partially control the detuning.

Finally, it is important to know that the control means for controlling the coupling constant and/or the detuning are arranged to operate during the activation of the power source. It is important that control of the coupling constant and detuning is achieved whilst the beam is being stored, as otherwise high beam currents cannot be achieved.

The present invention has further aspects. For example, the above acceleration device may be used in a ring type accelerator comprising a plurality of bending matters defining a loop path for the beam, and acceleration of the beam is then achieved thereby. Furthermore, the power coupler and detuning controller themselves are independent aspects of the present invention. Finally, the present invention relates to a method for controlling synchrotron radiation. In one development, this involves controlling of detuning and/or controlling of coupling constant simultaneous with the application of the high frequency pattern. Furthermore, the present invention permits the power/detune characteristic to be controlled so as to eliminate a region in which the beam is unstable, thereby allowing high beam currents to be achieved. Moreover, the present invention permits the detuning to be controlled at successive injections of charge particles into the beam, so that the beam can at all times be maintained in a tuned state.

BRIEF DESCRIPTION OF THE DRAWINGS

Embodiments of the present invention will now be described in detail, by way of example, with reference to the accompanying drawings, in which.

DETAILED DESCRIPTION

Figure 1:
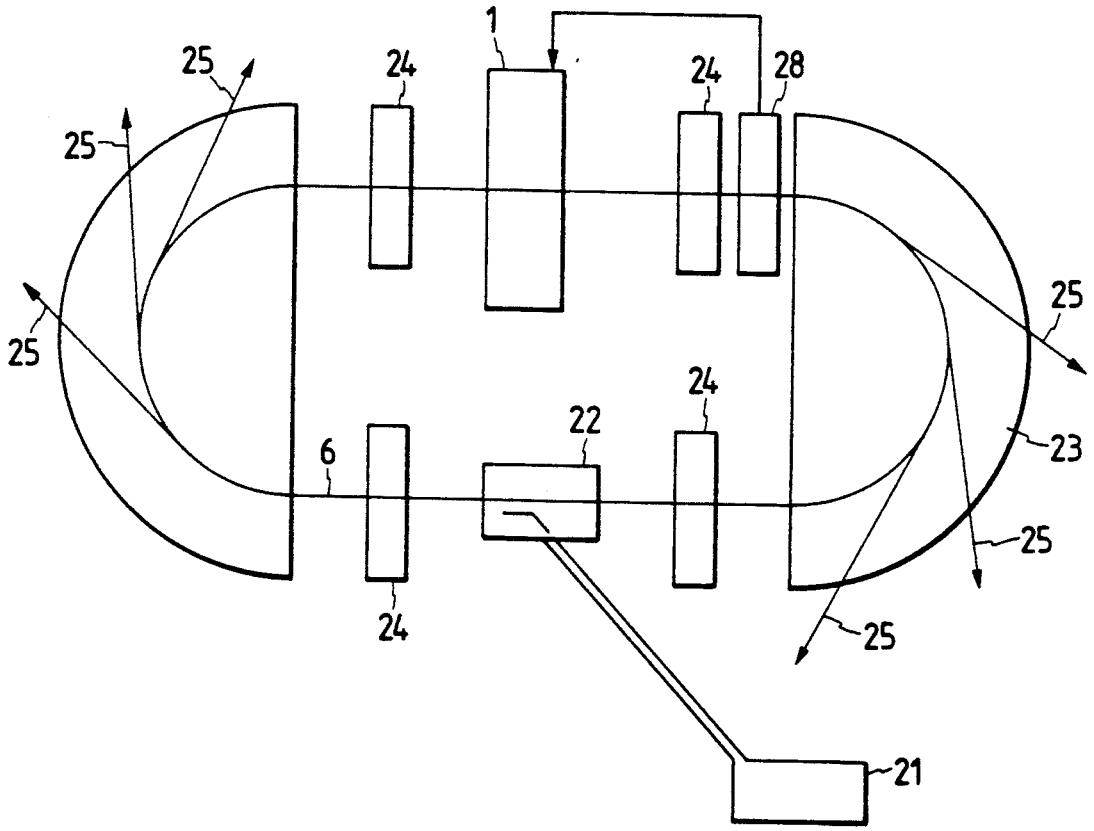
FIG. 1 shows schematically an accelerator in which an acceleration device according to the present invention may be used.

FIG. 1 shows a schematic view of a ring type acceleration device for generating synchrotron radiation. As shown in FIG. 1, a beam of charged particles such as electrons or ions is accelerated using a linear accelerator 21. From the linear accelerator 21, the charged particles are injected via injector 22 to form a beam 6 in the acceleration device. The beam 6 is caused to move in a looped path by a pair of bending magnets 23 which each bend the beam through 180°. The beam 6 is maintained in a converged state by quadrupole electromagnets 24. The beam 6 injected by the injector 21 is supplied with radio frequency energy from an acceleration device 1 (to be discussed in detail later) so that the energy of the beam 6 increases each loop of the beam path.

FIG. 1 shows that when the beam 6 is caused to change direction due to the bending magnets 23, the beam emits light in the form of synchrotron radiation 25. FIG. 1 also shows a detector 28 for detecting the parameters of the beam (e.g. beam energy) and for controlling the acceleration device 1.

Next, the importance of the coupling constant of the radio frequency acceleration cavity (acceleration device) will be explained with reference to FIG. 2.

Figure 2:
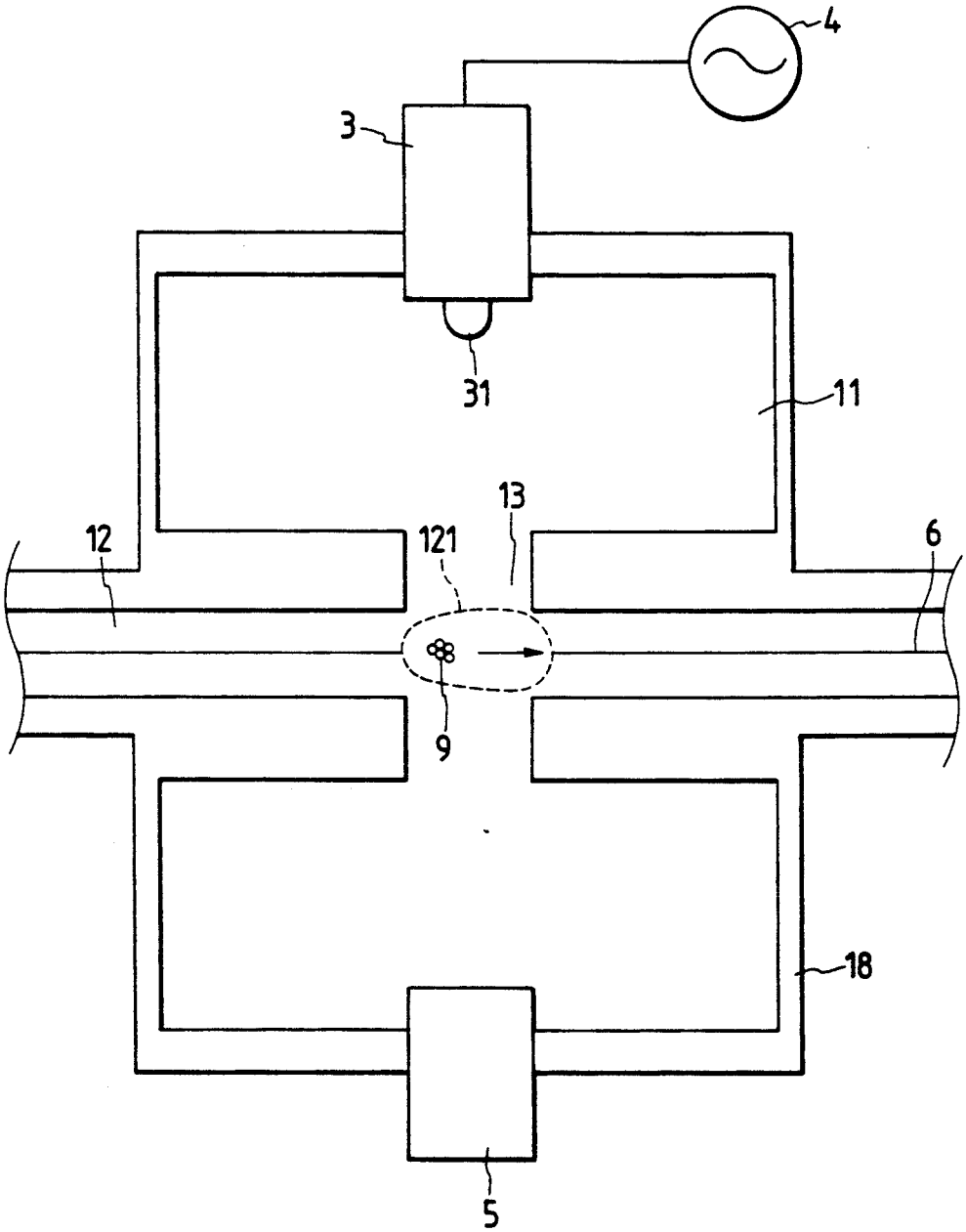
FIG. 2 is a diagram for explaining the action of a radio frequency acceleration cavity.

FIG. 2 shows the fundamental construction of the radio frequency acceleration device 1 having an acceleration cavity 11. Generally, a radio frequency acceleration cavity has a power coupler 3 which impresses electric power, a tuner 5 which controls the de-tune value, and a beam duct 12 through which the beam 6 passes. The charged particles 9 of the beam 6 are accelerated by an acceleration voltage $V_a$ which is generated in the vicinity of an acceleration gap 13 when the beam passes through the beam hole 12. This acceleration voltage $V_a$ is formed by the power applied to the interior of the cavity 11 via a radio frequency antenna 31 of the power coupler 3 from a radio frequency power source 4. Hence, the efficiency of the application of power to the interior of the cavity 11 depends upon the magnetic coupling between the radio frequency antenna 31 and the cavity 11. Therefore, if the coupling constant $\beta$, which indicates the efficiency of coupling, is controlled so as to minimise the reflected power, i.e. the power which is not applied to the interior of the cavity but is reflected by the power coupler 3, the acceleration voltage is formed using the minimum radio frequency power. In addition, in FIG. 2 there is shown the wall 18 of the cavity.

Thus, the coupling constant $\beta$ is a measure of the relationship between the high frequency power applied from the source 4 to the antenna 31 (transmission means) and the high frequency power applied from the antenna 31 to the cavity 11.

Figure 3:
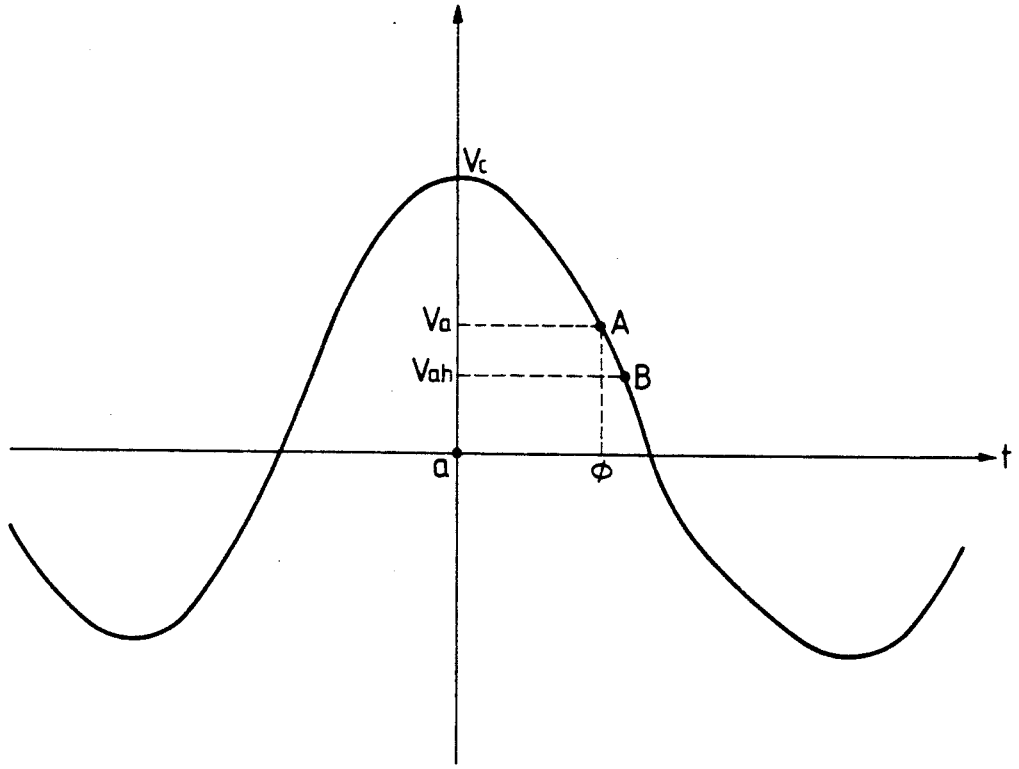
FIG. 3 is a diagram useful for explaining phase stability.

Next, referring to FIG. 3, the meaning of phase stability will be explained. FIG. 3 shows the change in the acceleration voltage $V_a$ with time, the acceleration voltage $V_a$ being generated in the accelerating part (see FIG. 2) of the beam duct 12. In FIG. 1, when the energy of the individual charged particle of the beam which is injected from the linear accelerator 21 rises above 1 MeV, the velocity of the charged particles approaches the speed of light. After that, the velocity of the charged particles remains the same even with further acceleration. At an energy above 1 MeV, a charged particle is not accelerated in speed but increases in energy. On the other hand, when the energy of the charged particles is increased, the radius of the track of the particle increases at the deflecting part where the bending magnets 23 are located. Therefore, in order to force the beam to follow a circulatory motion on the same track, the centripetal force applied by the bending magnet 23, that is to say, the strength of the magnetic field of the bending magnet 23 must increase with the increase in beam energy. This way of forcing the beam to take a fixed circulatory track by increasing the strength of the magnetic field of the bending magnet with increasing beam energy is called synchrotron acceleration. When charged particles with energy above 1 MeV are synchrotron accelerated, provided each charged particle of the beam has the same energy, each charged particle will go around the track in almost the same time. However, in practice, there is some scattering of the energy of the charged particles. As a result, a charged particle with a higher energy level follows a wider track and takes more time to complete a loop of the track, of the beam 6. Similarly a charged particle with a lower energy level takes less time. Thus there is a scattering in the time that the charged particles reach the accelerating part 121. In FIG. 3, the time coordinates proceed from left hand to the right hand side. Therefore consider a charged particle B having a higher energy than that of a charged particle A which particle A is in synchronism with the deflection magnetic field, in other words has average energy of a beam. Then, the particle B arrives later than the particle A, and thus the particle B is accelerated with an acceleration voltage $V_{ah}$ which is lower than $V_a$. Hence, the energy added to the charged particle B is less than that added to the charged particle A. This tends to cause the particle B to catch up with the particle A having the average energy. In most cases, the energy becomes less than average when it catches up with the charged particle A, so it goes round the circulatory track at a higher velocity. Again, the higher velocity causes a higher acceleration voltage, so the particle tends to go around more slowly. That is, many charged particles go round the looped path with oscillating energy (referred to as synchrotron oscillation) within a range of phase, shown in FIG. 3. The phase, as used here in the term "phase stability", means the phase of the acceleration voltage against a charged particle (hereinafter referred to as the acceleration phase). "Phase stability" means that the nature of the acceleration phase is such as to make stable the synchrotron oscillation. The condition in this state is called the "phase stability condition". For the charged particle to make a stable synchrotron oscillation without deceleration, it is necessary for the particle to fall within a region where positive energy is supplied to the charged particle from an acceleration phase $\phi$, and the particle must make a stable energy oscillation, that is to say, denoting the base point of acceleration phase $\phi$ by time a, it is necessary that $\phi$ falls in the region $0<\phi<\pi/2$.

Figure 4:
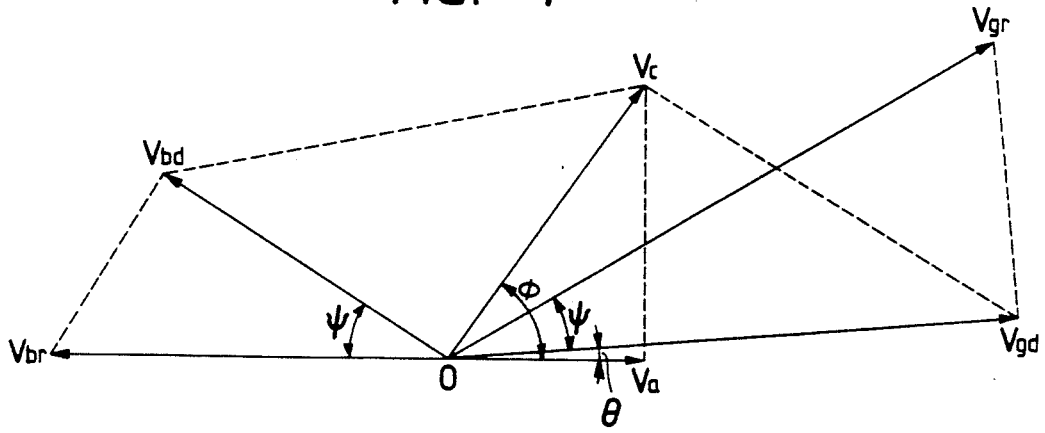
FIG. 4 is a diagram illustrating the relationship between acceleration cavity voltage, acceleration voltage and radio frequency power source voltage before and after a de-tune, and also showing beam induced voltage.

FIG. 4 is a diagram illustrating the relationship between the acceleration cavity voltage $V_c$, the acceleration voltage $V_a$, shown in FIG. 3, the radio frequency power source voltage $P_g$ which forms $V_c$ and the voltage $V_a$ induced by the beam $V_b$. The acceleration voltage $V_a$ can be determined using the acceleration cavity voltage $V_c$, and the acceleration phase $\phi$, from FIGS. 3 and 4.

$$V_a = V_c \cos \phi \tag{1}$$

The acceleration cavity voltage $V_c$ which is generated in the cavity is represented by the vector sum of the radio frequency power source voltage $V_{gd}$, which is generated after de-tune in the acceleration cavity delayed by a de-tune angle (4) (de-tune value converted into a phase change) in conformity with the de-tune change and the voltage induced by the beam $V_{bd}$. Both $V_{gd}$ and $V_{bd}$ fall on circles having diameters $OV_{gr}$, $OV_{br}$ which are formed by the radio frequency power source voltage before the de-tune voltage $V_{gr}$ and the induced voltage by beam $V_{br}$, thus, $V_a$ in formula (1) can be expressed by formula (2) using $V_{gr}$ and $V_{br}$.

$$V_a = V_{gr} \cos \psi \cos (\theta + \psi) = V_{br} \cos^2 \psi \tag{2}$$

The acceleration voltage at the existence of the beam is expressed by formula (2), in which, however, $V_{br}$ changes with the synchrotron oscillation and, therefore, has practically no effect on the phase stability. Accordingly, in formula (2), only component $V_{gr}$ determines phase stability.

Note that the condition for phase stability: $0<\phi<\pi/2$ is equivalent to: $dV_a/dt<0$.

Since the phase angle $\theta$ between the radio frequency power source voltage before de-tune and the acceleration voltage can be varied with a phase shifter (not illustration), $dV_a/dt<0$ can also be expressed as:

$$\frac{dV_a}{d\theta} < 0.$$

Substituting formula (2) into formula (3), to calculate $dV_a/d\theta$, converts the phase stability condition into:

$$V_{gr} \cos \psi \sin (\theta + \psi) > 0 \tag{3}$$

This is rearranged into formula (4) by eliminating $\theta$ from the equation for the component of the acceleration cavity voltage $V_c$ which is perpendicular to the acceleration voltage $V_a$, giving:

$$\frac{i_o R_{sh}}{1+\beta} \quad \frac{\tan\psi}{1+\tan^2\psi} > -V_c \sin\phi \tag{4}$$

where, $i_o$: Beam current $R_{sh}$: An equivalent resistance to create induced voltage $V_{br}$ ($R_{sh} = V_{br}/i_o$)

$\beta$: Coupling constant $\psi$: De-tune angle (the quantity determined by de-tune value $\Delta f$)

$V_c$: Acceleration cavity voltage $\phi$: Acceleration phase.

Accordingly, in the case of synchrotron acceleration, since the acceleration voltage $V_c$, and the acceleration phase $\phi$ are quantities determined by the strength generated in the bending magnet 23, it is possible to change the de-tune value $\Delta f$ and the coupling constant $\beta$, and to control both values to satisfy the formula (4). In addition, the inequality (4) indicates that controlling the de-tune value $\Delta f$ only is insufficient to maintain phase stability.

An embodiment of the invention will now be described referring to FIGS. 1, and 5 to 9. This embodiment of the invention is for an industrial light generator which has means for changing the coupling constant and means for changing the de-tune value over a wide range in a high frequency acceleration cavity.

FIG. 1 shows the general construction of the light generator being an accelerator to which the present invention is applied. As explained above, the light generator consists of a linear accelerator 21 as a preliminary accelerator, an injector 22, which injects a beam from the linear accelerator 21 so that the beam 6 follows a circulatory track, a high frequency acceleration cavity 1, which supplies energy to the injected beam, a bending magnet 23, which turns the beam track so that the beam can make a circulatory motion, and a plurality of quadrupole magnets 24, which converges the beam to avoid divergence in a radial direction. The beam injected from the injector 22 is supplied with energy from the high frequency acceleration cavity 1, then its energy increases with every loop of the circulatory track. When the beam changes its direction due to the bending magnets 24, it emits radiant light 25 in the tangential direction of the circulatory track. The radiant light 25 is taken out and may be used to etch a semiconductor.

Figure 5:
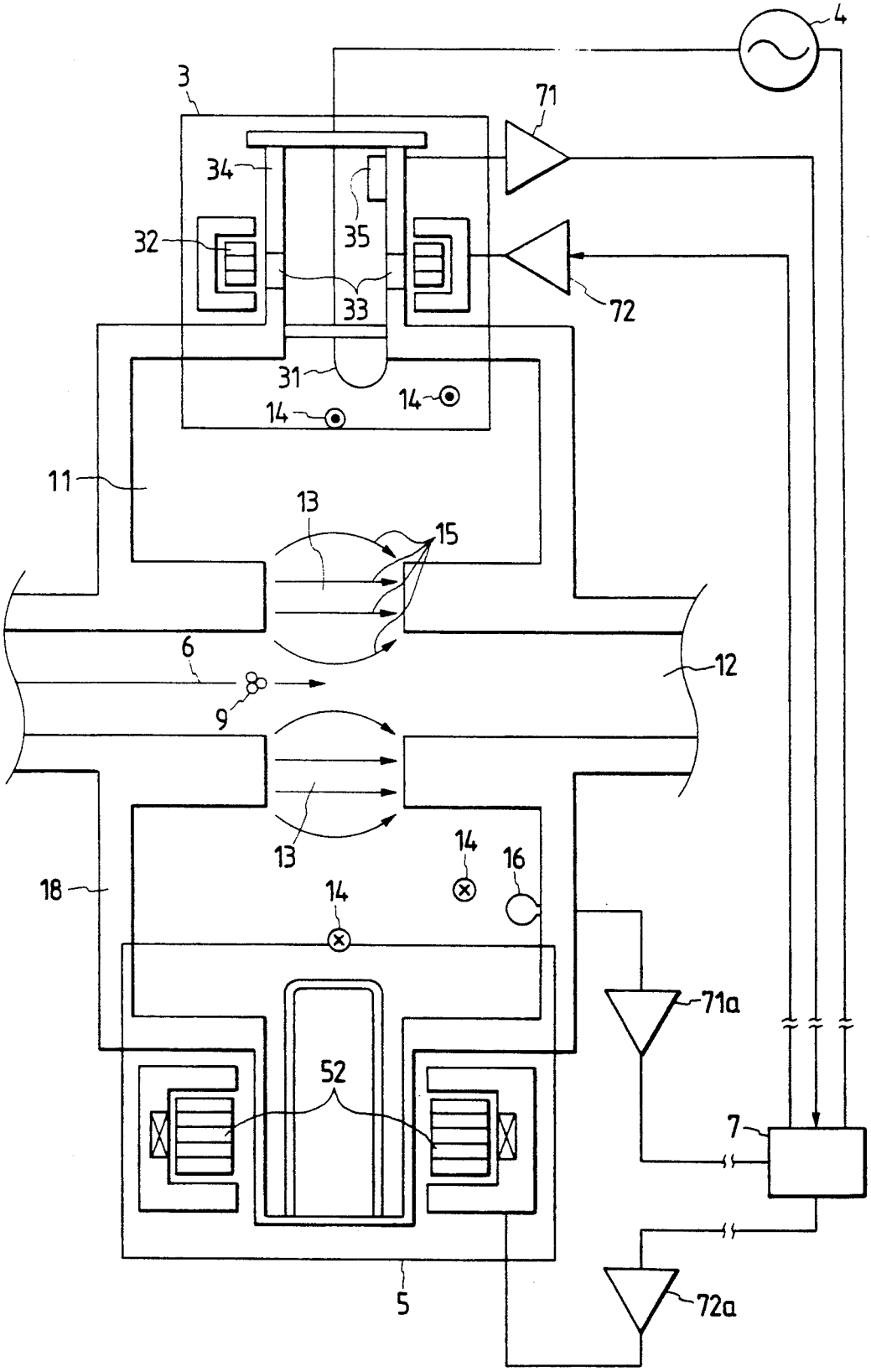
FIG. 5 is a sectional view through a first embodiment of an acceleration device according to the present invention.
Figure 6:
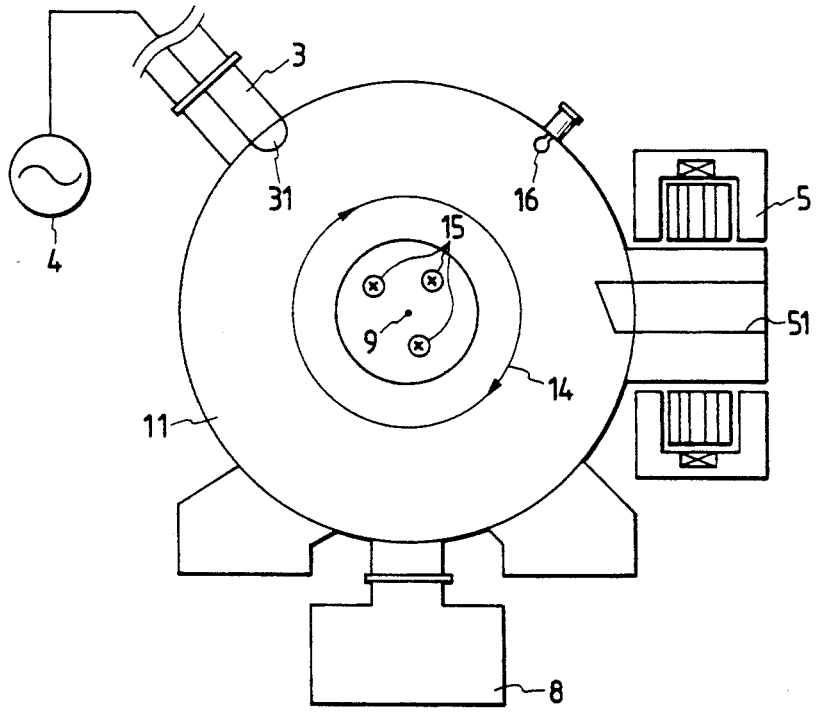
FIG. 6 is a sectional view of the embodiment of FIG. 5, viewed at right angles to the view in FIG. 5.

FIG. 5 shows an embodiment of a high frequency acceleration cavity 1 to which the present invention is applied. FIG. 5 shows a sectional view from above. FIG. 6 is a sectional view of the high frequency acceleration cavity 1 shown in FIG. 5 viewed in the direction of the beam. The high frequency acceleration cavity 1 comprises a power coupler 3, a high frequency power source 4, a tuner 5, a cavity 11 in which a high frequency electro-magnetic field is formed, and a beam duct 12 through which the beam 6 passes (the beam 6 comprising charged particles 9). Inside the cavity 11, as shown in FIG. 6, a predetermined vacuum pressure is maintained by a vacuum pump 8. The power coupler 3 applies high frequency electric power by forming a high frequency magnetic field 14, which is shown in FIGS. 5 and 6, in the cavity 11 by supply of high frequency current to a high frequency antenna 31. In FIG. 5, the symbol ⊙ means that the magnetic flux is in a direction from the face to the back of the sheet, and the symbol ⊗ means that the flux is in inverse direction from the back to the face. The high frequency magnetic field 14 forms a high frequency acceleration electric field 15 in the beam duct 12 and creates the acceleration voltage $V_a$. The beam 6 is accelerated by this acceleration voltage $V_a$ and increases its energy. The tuner 5 changes the form of the high frequency magnetism in the cavity 11 by changing the condition of magnetic coupling with the high frequency magnetic field 14, thus it changes the resonance frequency in the cavity, that is to say, the de-tune value.

First, referring to FIGS. 5 and 7, the means of changing the coupling constant will be explained, which change is a first object of the present invention.

Figure 7:
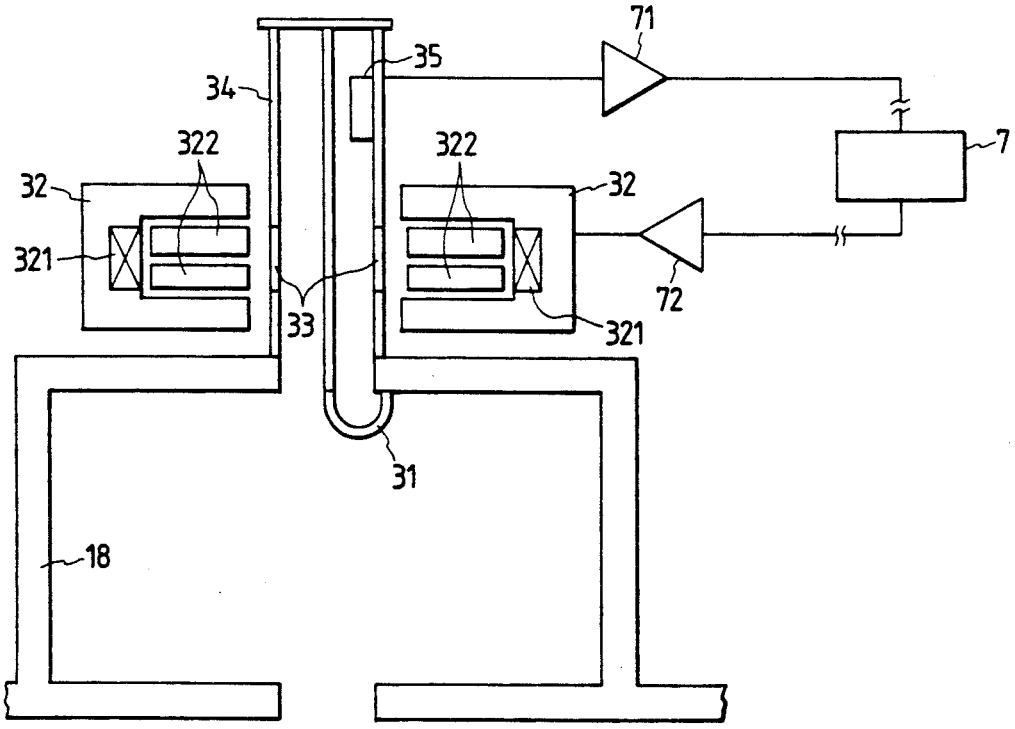
FIG. 7 is a detailed view of a power coupler used in the first embodiment of the present invention.

FIG. 7 shows a detailed diagram of the power coupler 3 which has means for changing the coupler constant. The power coupler 3 consists of a coaxial transmission tube 34, which is a main body case, the high frequency antenna 31, which has loop construction and runs through the coaxial transmission tube 34 and allows magnetic coupling with the inside cavity 11 at one end, a ceramic window 33 which draws a high frequency magnetic field which is generated by the high frequency current flowing in the high frequency antenna 31 into a bias unit of a power coupler 32, and a directional coupler 35 which measures the reflected power. The bias unit of the power coupler 32 changes the strength of the bias magnetic field which is generated on a power-use magnetic body 322 by changing the magnitude of the current flowing in a power coil 321, thus controlling the strength of the high frequency magnetic field which is drawn in through the ceramic window 33. As a result, it is possible to change the strength of the high frequency magnetic field H at the antenna part where the high frequency antenna 31 couples magnetically with the interior of the cavity 11. The coupling constant $\beta$ between the radio frequency acceleration cavity 1 and the radio frequency power source 4 is expressed by the following formula:

$$\beta \propto \mu_o H^2 S^2 \tag{5}$$

where, $\mu_o$: Magnetic permeability of vacuum

H: The strength of high frequency magnetic field at the part of antenna

S: Area of coupling at the part of antenna

The equation (5) shows that the coupling constant $\beta$ can be changed by changing the strength of high frequency magnetic field H and area of coupling S. However, it is impossible to change the area of coupling S during the circulatory motion of the charged particles, but the coupling constant $\beta$ can be changed by changing the magnitude of the current flowing in the power coil 321. For example, if the reflected power is measured by the directional coupler 35, and the coupling constant $\beta$ is controlled so as to make the reflected power equal to zero, then all of the power generated by the radio frequency power source 4 can be applied to the radio frequency acceleration cavity. In addition, FIG. 7 shows an amplifier 71 for the reflected power which is detected by the directional coupler 35, and is a driver amplifier 72 which sends a current into the power coil 321. The control described above is performed by the controlling equipment 7 of these units.

As is evident from the above explanation, high frequency power can be efficiently applied to the high frequency acceleration cavity by providing means for making the coupling constant $\beta$ of the high frequency acceleration cavity changeable.

Next, referring to FIGS. 5 and 8, the action of the high frequency acceleration cavity which allows a high de-tune, a second object of the present invention, will now be described.

Figure 8:
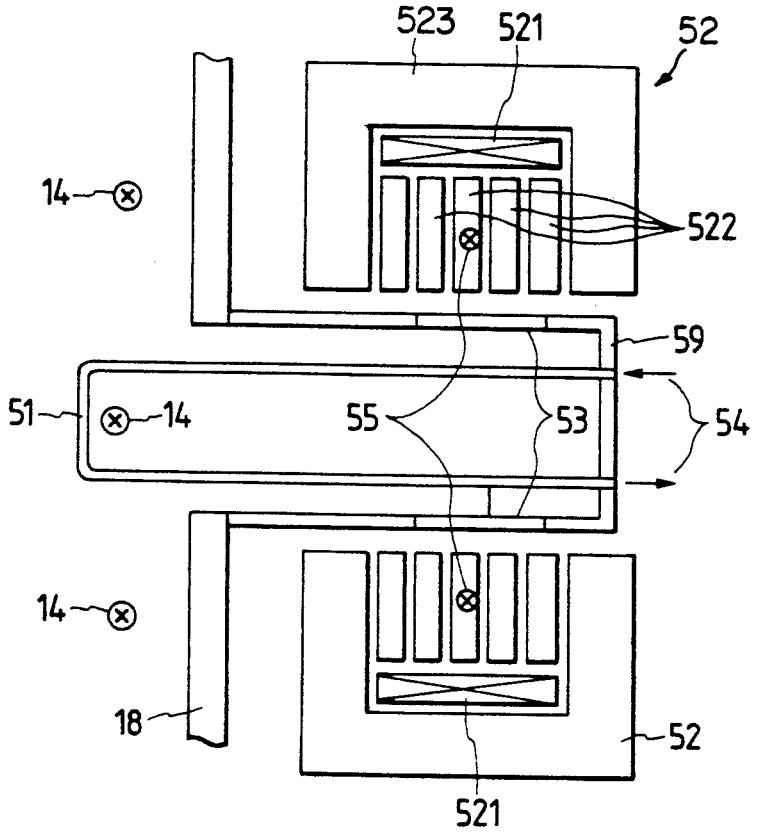
FIG. 8 is a detailed view of a tuner used in the first embodiment of the present invention.

FIG. 8 shows a detailed diagram of the tuner 5 shown in FIG. 1. The tuner 5 consists of a looped construction forming a "flapper coupling" 51 which magnetically couples with the high frequency magnetic field 14 in the inside of the cavity 11, a ceramic window 53 which draws the high frequency magnetic field 55 into a tuner bias unit 52 with a high frequency current flowing in a flapper coupling 51 and the tuner bias unit 52. The flapper coupling 51 is a hollow conductor and is fixed on a tuner port bottom plate 59.

The action of the flapper coupling will now be explained.

When the flapper coupling 51 is exposed to a magnetic field, a high frequency current proportional to the area of intersection with the high frequency magnetic field in the acceleration cavity flows in the flapper coupling 51. In the flapper coupling 51, this high frequency current returns directly to the magnetic body of the tuner 5. Therefore, the high frequency magnetic field in the acceleration cavity can be transmitted to the magnetic body without attenuation. If transmission without attenuation is achieved, the ease of flow of high frequency current is greatly influenced by change in the magnetic permeability, etc. of the magnetic body. In other words, the magnetic impedance of the tuner 5 viewed from the high frequency acceleration cavity changes greatly. As a result, the reactance component of the high frequency cavity changes greatly, thus the resonance frequency changes in the high frequency acceleration cavity, that is to say, the de-tune value can be made to fluctuate over a wide range.

In FIG. 8 the tuner bias unit 52 has substantially the same construction as the power coupler bias unit 32. The tuner bias unit 52 consists of a tuner-use magnetic body 522 which has the nature of specific magnetic permeability $\mu > 1$ in the high frequency region, a tuner coil 521 which generates a bias magnetic field $H_B$, which is generated on the tuner-use magnetic body 522 and a tuner yoke 523. A change in magnitude of the bias magnetic field $H_B$, which is generated on the tuner-use magnetic body 522 causes a change in the specific magnetic permeability of the tuner-use magnetic body $\mu_{rf}$. This causes a change in the ease of passing through the tuner-use magnetic body 522 for the high frequency magnetic field 55. It is thus apparent that a field strength/permeability relation exists. The value of $\mu_{rf}$ at this moment is expressed by the following formula using the bias magnetic field $H_B$:

$$\mu_{rf} = 1 + 4\pi\, M_s/H_B \tag{6}$$

where, $M_s$: Saturated magnetization of the tuner-use magnetic body 522.

For example, if the passage of the high frequency magnetic field 55 is difficult, then the flow of high frequency current in the flapper coupling 51 also becomes difficult. The fact that the flow of the high frequency current is difficult means that the magnetic coupling condition deteriorates for the flapper coupling 51 and inside the cavity 11. In other words, there is a decrease in the high frequency magnetic field inside the cavity 11 which intersects with the flapper coupling 51. This causes a change in the shape of the magnetic field inside the cavity 11. The change in shape of the magnetic field inside the cavity 11 causes a change in the inductance L inside the cavity 11. The resonance frequency f inside the cavity is expressed by following formula:

$$f \propto 1/\sqrt{LC} \tag{7}$$

where,

L: Inductance inside the cavity

C: Capacitance inside the cavity

Therefore, by changing the current flowing in the tuner coil 521, the specific magnetic permeability $\mu_{rf}$ of the tuner-use magnetic body 522 changes, affecting the resonance frequency f inside the cavity. In other words, the de-tune value $\Delta f$ can be changed. This change in current in the tuner coil 521 is controlled by the controlling equipment 7 via an amplifier 72a (FIG. 5).

The de-tune value $\Delta f$ is expressed by following formula, where the stored energy in the cavity is denoted by U, the specific magnetic permeability of the tuner-use magnetic body is denoted by $\mu_{rf}$, the high frequency magnetic field on the tuner-use magnetic body is denoted by $H_c$, the resonance frequency is denoted by f, the magnetic permeability of vacuum is denoted by $\mu_o$:

$$\Delta f = \frac{\mu_{rf}\mu_o H_c^2}{4U}\,\Delta v * f \tag{8}$$

where, $\Delta v$: Volume of the tuner-use magnetic body.

The above explanation and the formula (8), show that it is important for a high de-tune value $\Delta f$ to be obtained, so that the high frequency magnetic field 14 in the cavity is transmitted to the tuner-use magnetic body 522 without attenuation. In conventional technology, the high frequency magnetic field 14 is captured by a loop antenna and transmitted through a co-axial construction. Therefore, the strength of the high frequency magnetic field is attenuated exponentially. Hence a high de-tune value $\Delta f$ cannot be obtained. On the other hand, in the present invention, the high frequency magnetic field 14 is captured by the flapper coupling 51 in the cavity 11 and can be directly transmitted to the tuner-use magnetic body 522. Therefore, the high frequency magnetic field strength can be transmitted without attenuation. As the result, a de-tune value at least twice as large as that in conventional technology can be obtained. In addition, the formula (8) shows that this method offers a fine tuning range $\mu_{rf}$ times as great as the de-tune value obtained by a conventional mechanical tuner.

Moreover, if the flapper coupling 51 requires cooling, very simple cooling construction is available by sending coolant 54 through the interior of the hollow conductor which forms the flapper coupling 51.

Figure 9:
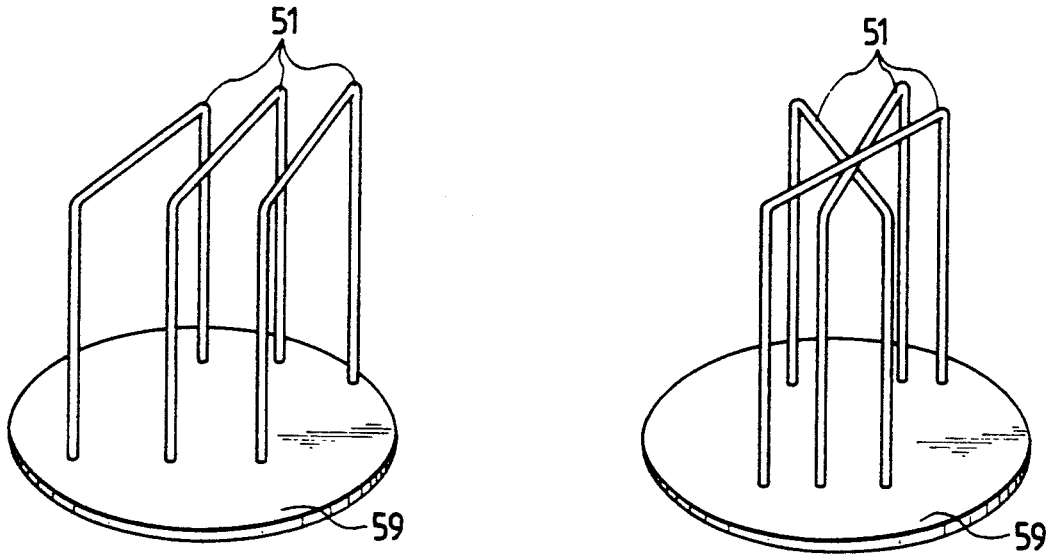
FIG. 9 shows alternative flapper couplings for use in the tuner of FIG. 8.

Furthermore, since this tuner has no moving parts in an ultra high vacuum, the reliability of the tuner is increased. In this first embodiment of the invention, the use of a single flapper coupling was explained for the sake of simplicity. However, as shown in FIG. 9, a multiplicity of flapper couplings 51 may be used in an arrangement in which the flapper couplings 51 are parallel or have a different angle for each flapper coupling 51.

As described above, in the present invention, a de-tune value twice as great can be obtained by using a flapper coupling to make a coupling of the high frequency magnetic field in the cavity. In addition, a simple cooling construction is available by forming the flapper coupling from a hollow conductor.

Next, referring to FIGS. 1 and 5, the means to maintain always synchrotron phase stability and the method of performing synchrotron acceleration with a satisfactory phase stability will be explained, which are the third and fourth objects of the invention.

Suppose that a beam of low energy and a large current is injected from the injector 22 and is synchrotron accelerated to a high energy level in a stable condition. In synchrotron acceleration, the magnetic flux B of the deflection magnetic field is changed by the bending magnet 23 in response to the energy of the beam. In practice, an operation plan for the magnetic flux B(t) of the bending magnetic field is prepared and the de-tune value, etc. are controlled synchronously with B(t). That is to say, given the bending magnetic field $B(t_o)$ at certain time $t_o$, then the acceleration voltage $V_a(t_o)$ is determined as required by consideration of the lost radiant light energy $E_{loss}$ of the beam 6 during its circulatory motion in order to cause the beam 6 to follow the appropriate looped path. As it is difficult to measure the acceleration voltage $V_a(t)$, the acceleration cavity voltage $V_c(t)$ and the acceleration phase $\phi(t)$, which create the acceleration voltage $V_a(t)$ are measured. In FIG. 5, the acceleration cavity voltage $V_c(t)$ is measured by measuring the loop antenna 16. The acceleration phase $\phi(t)$ cannot be measured. However, even if it cannot be measured, by determining the acceleration cavity voltage $V_c(t)$, the beam makes circulatory motion by itself thereby satisfying the acceleration phase $\phi(t)$. The behavior of the beam is explained by reference to FIG. 3. Assume the required acceleration voltage for the beam is $V_a$, and the acceleration cavity voltage simultaneously set is $V_c$. Then a charged particle 9 which is accelerated with an acceleration cavity voltage of the value at point A takes the central circulatory track. Another charged particle which is accelerated with a lower acceleration voltage $V_{ah}$, in other words, a charged particle accelerated earlier with a lower energy, takes a different circulatory track as explained above. Therefore, when the particle arrives at the high frequency acceleration cavity 1, the particle tends to catch up with the particle that had been accelerated at point A. Ultimately, the charged particle has a synchrotron oscillation around point A and the beam is, on average, accelerated in the acceleration phase $\phi$. Accordingly, by setting the acceleration cavity voltage $V_c$ at $V_c(t)$ which is synchronized with the deflection magnetic field B(t), the control variables of the high frequency acceleration cavity may be controlled. Specifically, since the acceleration cavity voltage $V_c(t)$ and the acceleration phase $\phi(t)$ are known, by controlling the coupling constant $\beta$ and the de-tune angle $\psi$, which are on the left hand side of the inequality (4) in the way such that the phase stability condition of the inequality (4) is satisfied, a constantly stable synchrotron acceleration can be achieved. The high frequency power $P_g(t)$ which is supplied by the high frequency power source 4 is determined by the formula (9):

$$P_g = \frac{V_c^2(t)}{R_{sh}} \cdot \frac{1+\beta(t)}{4\beta(t)} \cdot \frac{1}{\cos^2(t)} (\cos\phi(t) + \alpha(t)\cos^2\psi(t))^2 + (\sin\theta(t) + \alpha(t)\cos\psi(t)\mathrm{Sin}\psi(t))_2 \quad (9)$$

$$\text{where, } \tan(t) = \frac{2\theta_o}{1+\beta(t)} \cdot \frac{\Delta f(t)}{f}$$

$$\alpha(t) = \frac{i_o R_{sh}}{V_c(t)(1+\beta(t))}$$

Therefore, by setting the conditions for synchrotron acceleration such that the deflection magnetic field B(t) will be increased, the acceleration cavity voltage $V_c(t)$ and the acceleration phase $\phi(t)$ are determined according to deflection magnetic field B(t), and by determination of $V_c(t)$ and $\phi(t)$, the de-tune angle $\phi(t)$ (de-tune value $\Delta f$ (t)) and the coupling constant $\beta(t)$ are determined so as to satisfy the inequality (4). Then, using formula (9), the high frequency power $P_g$ is determined. By controlling the radio frequency power source 4, the power coupler 3 and the tuner 5, stable synchrotron acceleration can be maintained. This function is performed by the controlling equipment 7. Previously described methods change the coupling constant of the power coupler 3 and the de-tune value $\Delta f$ of the tuner 5.

Using this method, the controlling coupling constant $\beta$ and the de-tune angle $\psi$ is adopted to satisfy the inequality (4), but this will not always give a minimum value for the controlled high frequency power which is determined by formula (9). A method for solving this problem is described below.

The minimum consumption of high frequency power for control is achieved when all the power transmitted on the high frequency antenna 31 of the power coupler 3 is applied to the interior of the cavity 11, and is controlled to create the required acceleration voltage. Thus it is necessary to apply all of the high frequency power transmitted to the high frequency antenna 31 to the interior cavity means to eliminate all reflected power which has already been described above. However, the following means is employed to get the required acceleration cavity voltage $V_c$. If the coupling constant $\beta$ is determined, the acceleration cavity voltage $V_c$ is determined depending on the de-tune value $\Delta f$ and the high frequency power $P_g$. Accordingly, the actual acceleration cavity voltage $V_{cr}$ is measured by a measuring loop antenna 16. The signal from the measuring loop antenna 16 is fed via an amplifier 71*a* (FIG. 5) to the controlling equipment 7. Then the de-tune value $\Delta f$ and the high frequency power $P_g$ are controlled so as to achieve the required acceleration cavity voltage $V_{cp}$. As the result, both the de-tune value $\Delta f$ and the high frequency power vary to compensate each other. For example, if the high frequency power $P_g$ increases, then the de-tune value $\Delta f$ varies to compensate for it, or if de-tune value $\Delta f$ changes, then high frequency power $P_g$ will change to compensate for it. That is to say, the control progresses with mutual compensation. This means, from the viewpoint of the high frequency power $P_g$, that control is progressing to have a minimum value power against the difference in the de-tune value $\Delta f$.

Explanation will now be given of how the method described above always satisfies the phase stability condition. The fact that the high frequency power $P_g$ is controlled to take a minimum value through coupling constant $\beta$ and de-tune value (de-tune angle $\psi$ (psi))

means that the coupling constant $\beta$ and the de-tune angle $\psi$ (psi) are controlled so as to satisfy the relationship of formula (10):

$$\partial^2 P_g/\partial\psi\cdot\alpha\beta=0 \quad (10)$$

where, applying the relation: $\partial P_g/\partial\psi=0$, the following is obtained $$\tan\psi = -\frac{i_o R_{sh}}{V_c(1+\beta)}\,\mathrm{Sin}\phi \quad (11)$$

Applying formula (11) to the inequality (4) of the phase stability condition and rearranging it, the phase stability condition can be expressed as follows:

$$\beta > P_b/P_c - 1 \quad (12)$$

where, $P_b = i_o V_a$: Beam power consumption $P_c = V_c^2/R_{sh}$: Power loss at cavity wall Applying formula (11) into formula (9) to get $\partial^2 P_g/i\psi\cdot\partial\beta=0$, then expressing it with $P_b$ and $P_c$:

$$\beta = P_b/P_c - 1 \quad (13)$$

is obtained. Since formula (13) always satisfies the inequality (12), if the high frequency power is controlled to a minimum at the coupling constant of $\beta$ and the de-tune value of $\Delta f$, then a stable synchrotron acceleration can be maintained.

As described above, if the control progresses to make the coupling constant $\beta$ and de-tune value $\Delta f$ satisfy the inequality (4) of the phase stability condition, or to minimize the high frequency power, then a stable synchrotron acceleration is maintained.

Figure 10:
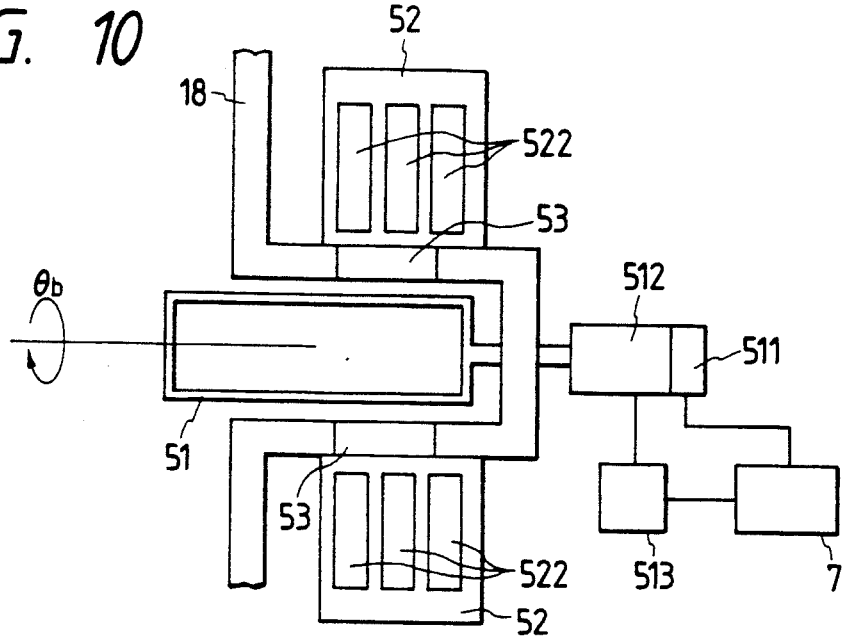
FIG. 10 shows a second embodiment of an acceleration device according to the present invention.

Next, referring to FIG. 10, a second embodiment of a high frequency acceleration cavity will be explained which allows a high de-tune value.

Looking at formula (8), the appropriate de-tune value $\Delta f$ can be achieved by changing the strength of the magnetic field $H_b$ on the tuner-use magnetic body instead of the magnetic permeability $\mu_{rf}$ of the tuner-use magnetic body 522. In the second embodiment of the present invention, means for changing the angle of a flapper coupling 51 is provided and the strength of the high frequency magnetic field $H_b$ on the tuner-use magnet body is changed. With a change in the angle of the flapper coupling 51, the intersecting area with the high frequency magnetic field 14 inside the cavity 11 changes. Then the strength $H_b$ of the high frequency magnetic field 55, which is introduced on the tuner-use magnetic body, can be changed. If the rotation angle $\theta_f$ of the flapper coupling is considered to be zero when the flapper coupling takes a position parallel to the surface of the paper, then the strength $H_b$ of the high frequency magnetic field 55, which is introduced on the tuner-use magnetic body, is expressed by the formula 14:

$$H_b = H_{bo}\cos^2\theta_f \quad (14)$$

where, $H_{bo}$: The strength of the high frequency magnetic field 55 at $\theta_f=0$.

Control of the angle of the flapper coupling is achieved by driving a motor 512 while monitoring the actual angle by the controlling equipment 7 using an angle detector 511. In addition, FIG. 10 shows an amplifier 513 to drive the motor 512.

As explained above, this second embodiment of the invention also permits the production of a high frequency acceleration cavity which allows a high de-tune value by using a flapper coupling and changing its angle.

Figure 11:
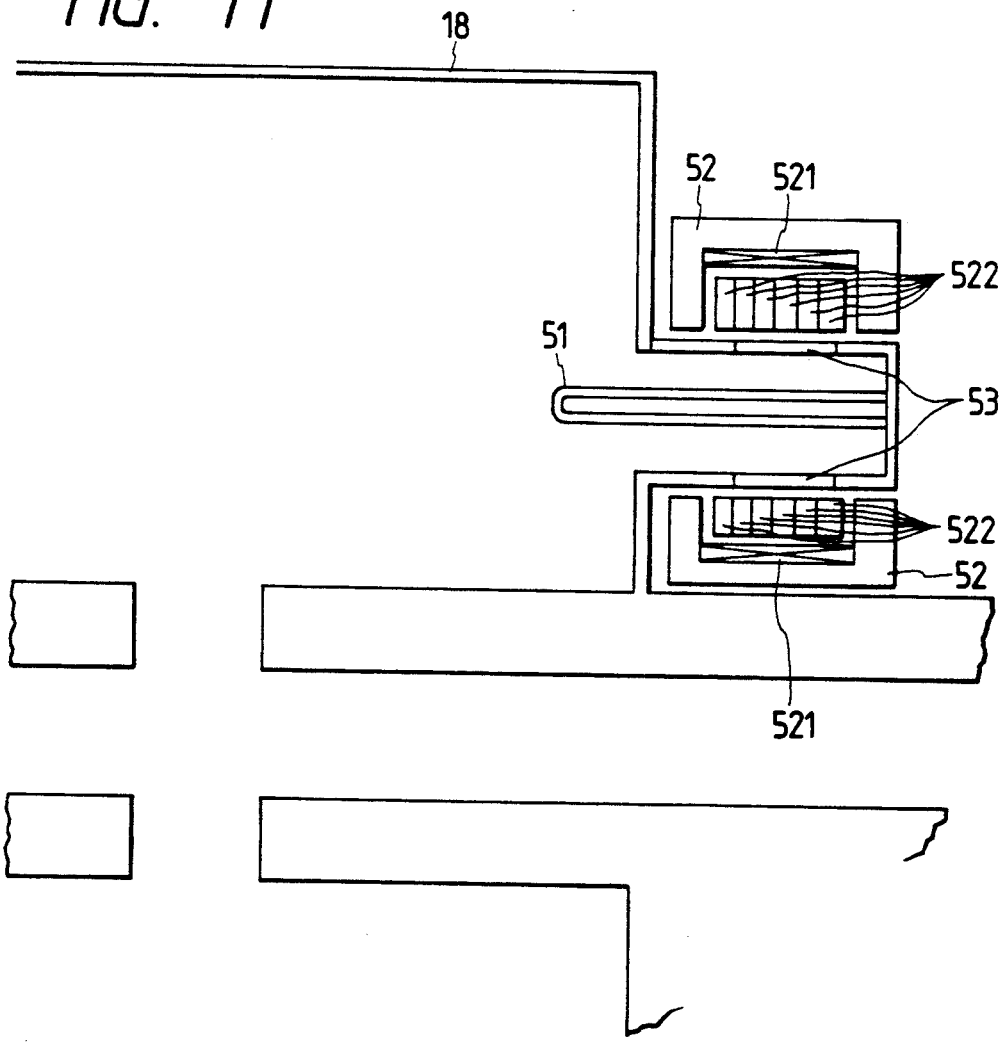
FIG. 11 shows a third embodiment of an acceleration device according to the present invention.

FIG. 11 shows a third embodiment of the high frequency acceleration cavity which allows a high de-tune value with the high frequency electric field in the cavity.

Normally, a high frequency magnetic field is generated in a direction perpendicular to the direction of the beam and a high frequency magnetic field is generated in the same direction as the forward direction of the beam. Therefore as shown in FIG. 11, a tuner 5 may be attached to the side of the high frequency acceleration cavity. The configuration of the tuner for this case is substantially the same as in FIG. 8. However, to improve coupling of the flapper coupling 51 and the high frequency electric field, the flapper coupling 51 is prepared with smaller loop area. As the result, similar to FIG. 8, a high frequency current flows on the flapper coupling 51, and the high frequency magnetic field is transmitted without attenuation on the tuner-use magnetic body 521. Therefore, a high de-tune value of $\Delta f$ is achieved.

As explained above, by coupling the flapper coupling with the high frequency electric field in the cavity, the high frequency acceleration cavity allows a high de-tune value.

Figure 12:
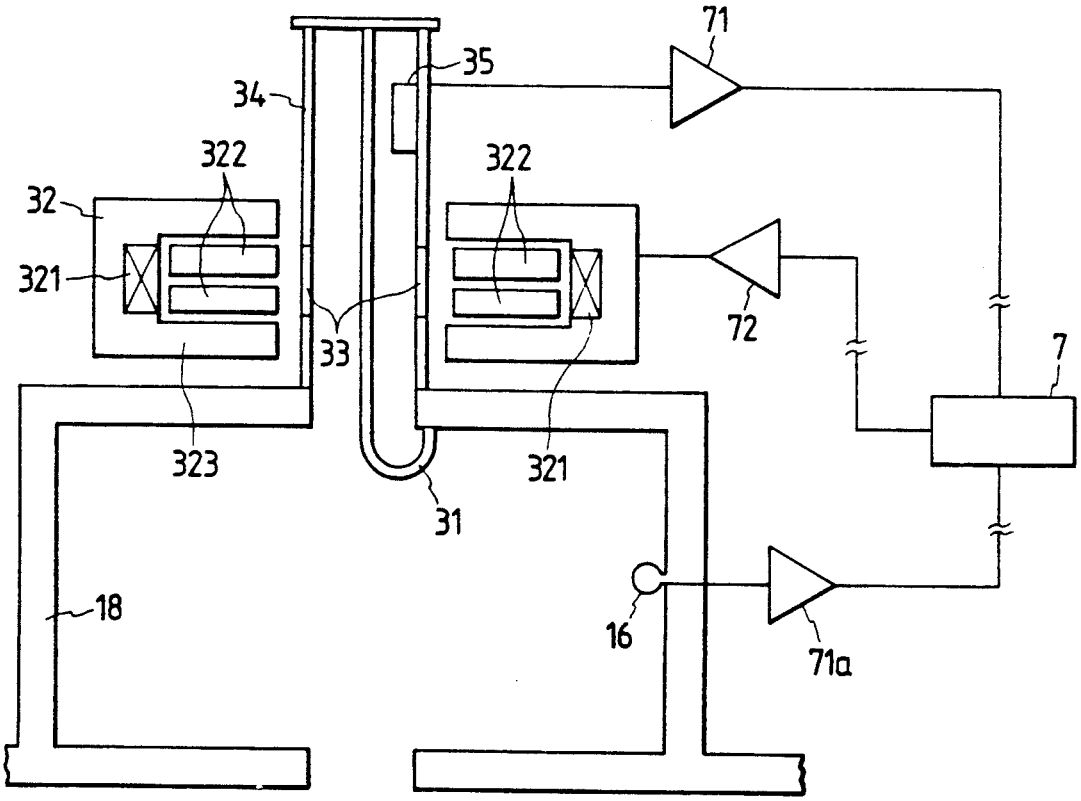
FIG. 12 shows a fourth embodiment of an acceleration device according to the present invention.

Referring to FIG. 12, a fourth embodiment of the invention being an example of a high frequency acceleration cavity which has combined power coupler and tuner will be explained.

As already discussed with reference to the first three embodiments of the invention, the de-tune value of the high frequency acceleration cavity and the coupling constant of a high frequency antenna can be controlled by changing the strength of the high frequency magnetic field at respective positions of the cavity. Therefore the fundamental construction of this embodiment, which controls the de-tune value and the coupling constant at one location similar to the arrangement shown in FIG. 7. Its difference lies in its method of controlling the bias magnetic field. The following is an example of the controlling method of this embodiment. If the current which is sent into a power coil to change the coupling contant by the reflected power obtained from a directional coupler 35 is denoted by $I\beta$, and the current which is sent into the power coil to change the de-tune value $\Delta f$ by the difference between desired acceleration cavity voltage $V_{cp}$ and the actual acceleration cavity voltage $V_{cr}$ detected by a measuring loop antenna 16 is denoted by $I\Delta_f$, then the current I which is sent into the power coil to control the bias magnetic field is determined by formula (15):

$$I = \gamma I\beta + \delta I\Delta_f \quad (15)$$

where, $\gamma,\delta$: Weighing constants, which take values: $0<\gamma,\delta>1$ Accordingly, by selecting the values for weighing constants in order to satisfy the phase stability condition of inequality (4), the coupling constant $\beta$ and the de-tune value $\Delta f$ can be controlled in a harmonized way. This control is performed by the controlling equipment 7.

As explained above, this embodiment, by a provision of a tuner function in a power coupler realizes a simple construction of a high frequency acceleration cavity with a secured phase stability.

In the above embodiments of the invention, the acceleration system used a ring type accelerator which has a synchrotron function. However, the invention also applies to an accumulation ring which has an accumulating function only. In an accumulation ring of this type, the beam is accumulated with a certain fixed energy. If the magnitude of the current, which is injected into the accumulation ring, changes, it will be de-tuned in response to the magnitude of the current and if the magnitude of the current changes greatly, it will be necessary to provide a high frequency acceleration cavity which has a high de-tune value. Notwithstanding this, the present invention is effective for any ring type accelerator to achieve efficient injection into the cavity with a minimum of reflected power.

In addition, only one piece of controlling equipment 7 in the above explanation is referred to. However, it is also possible to provide separate pieces of controlling equipment for the high frequency acceleration cavity and for the high frequency power source.

The present invention controls acceleration of a beam of charged particles using an acceleration device by applying high frequency power to the acceleration device so as to accelerate the beam, controlling the detuning of the high frequency power to the beam, and controlling the coupling constant of the high frequency power to the beam with the control of detuning and the control of the coupling constant being effected simultaneously with the application of the high frequency power. Additionally, for control of a ring-type accelerator system utilizing a synchrotron ring or an accumulator ring, charged particles are injected into the system to form a beam of the charged particles with the injection of the charged particles into the system being repeated a plurality of times so as to increase in a plurality of steps the number of the charged particles in the beam, and controlling detuning of a defined frequency difference between the high frequency power and accelerating power of the particles during the injection controlled. According to the present invention, the controlling of the detuning is pre-programmed in advance of the injecting of the charged particles. Furthermore, the detuning is detected between each repetition of the injection step and the controlling of the detuning is carried out in dependence on the detected detuning.

The present invention also enables control of synchrotron acceleration of a beam of charged particles using an acceleration device by applying high frequency power to the acceleration device so as to accelerate the beam, controlling the high frequency power to the beam and controlling a magnetic coupling constant of the high frequency power to the beam. Additionally, control of a ring-type accelerator system includes injecting charged particles into the system to form a beam of the charged particles, repeating the injection a plurality of times so as to increase in a plurality of steps the number of the charged particles in the beam and controlling the high frequency power to the beam during the injection.

The present invention may have a configuration as described above, hence it may exhibit the effects described below.

By providing a way of changing the coupling constant of a high frequency acceleration cavity, high frequency power can efficiently be applied to the high frequency acceleration cavity.

Furthermore, by providing a flapper coupling which has a loop shape part which generates a magnetic field on its magnetic body, in the tuner of the high frequency acceleration cavity, it is possible to have a high frequency acceleration cavity, which permits a high de-tune value.

Furthermore, by providing a coil which changes the bias magnetic field of the magnetic body, in the tuner of the high frequency acceleration cavity, and changing the current, a high frequency acceleration cavity can be produced which permits a high de-tune value of high reliability.

Alternatively by providing a flapper coupling and a means to rotate the flapper coupling against a tune-use magnetic body, by changing the rotation angle, it is also possible to provide a high frequency acceleration cavity, which permits a high de-tune value. By measuring the acceleration cavity voltage and the reflected power of the high frequency power, by proper arrangement of their ratio contributing to the coupling constant and the de-tune value, a high frequency acceleration cavity of a simple construction which has a power coupler with a combined tuner is possible.

Furthermore, by providing a power coupler which has means for changing the coupling constant and a tuner which can change greatly the de-tune value, it is possible to produce a ring type accelerator having synchrotron function which can satisfy phase stability even for a large current.

Furthermore, by performing cooperative control which guarantees synchrotron phase stability conditions for the coupling constant and de-tune value of the high frequency acceleration cavity, stable synchrotron acceleration is always possible.

Finally, by controlling the coupling constant and de-tune value of the high frequency acceleration cavity to minimize the high frequency power, it is possible to maintain stable synchrotron acceleration.

What is claimed is:

1. An acceleration device for charged particles comprising:

an acceleration cavity;

a source activatable to generate high frequency power;

transmitting means for transmitting said high frequency power from said source to said cavity so as to generate cavity power for controlling the energy of said charged particles utilizing a magnetic coupling constant between said high frequency power and said cavity power; and control means for controlling said transmitting means so as to control said magnetic coupling constant, said control means being arranged to act during existance of said charged particles in said cavity.

2. A device according to claim 1, wherein said transmitting means is coupled to said cavity in dependence on an area of said transmitting means and a field strength, and said control means is arranged to vary said field strength thereby to vary said coupling of said transmitting means to said cavity.

3. A device according to claim 1, wherein said transmitting means is coupled to said cavity, and said control means includes bias means for applying a bias to said coupling of said transmitting means to said cavity in dependence on a bias current, and current control means for controlling said bias current so as to control said coupling of said transmitting means to said cavity.

4. A device according to claim 3, wherein said bias means comprises at least one magnetic body and at least one coil for causing said at least one magnetic body to generate a bias magnetic field arranged to act on said transmitting means.

5. An acceleration device according to claim 3, wherein said bias means is connected to said cavity, and said current control means is arranged to control said bias means so as to control detuning of said cavity power relative to said high frequency power.

6. An acceleration device according to claim 1, further comprising detuning control means for controlling detuning of an acceleration power relative to said high frequency power.

7. An acceleration device according to claim 6, wherein said acceleration power causes a field in said cavity; and said detuning control means includes at least one looped conductor in said cavity for coupling with said field and extracting power from said field, and means for controlling the extraction of power from said field by said at least one looped conductor.

8. An acceleration device according to claim 7, wherein said at least one looped conductor is hollow.

9. An acceleration device according to claim 7, further including means for detecting said detuning of said acceleration power relative to said high frequency power, and for generating an output to said detuning control means.

10. An acceleration device according to claim 7, wherein said means for controlling the extraction of power from said field comprises a magnetic body for influencing said coupling of said at least one looped conductor with said field; and means for controlling the specific magnetic permeability of said magnetic body on said at least one looped conductor.

11. A device according to claim 1, wherein said transmitting means includes an antenna for enabling generation of a magnetic field for coupling to said cavity.

12. An acceleration device for charged particles comprising:

an acceleration cavity;

a source activatable to generate high frequency power;

transmitting means for transmitting said high frequency power from said source to said cavity so as to generate cavity power for controlling the energy of said charged particles, there being a coupling constant between said high frequency power and said cavity power; and control means for controlling said transmitting means so as to control said coupling constant, said control means being arranged to act during existence of said charged particles in said cavity;

wherein said transmitting means is also capable of generating reflected power, and said control means is arranged to control said coupling constant so as to control said reflected power.

13. A device according to claim 12 wherein said control means is arranged to control said coupling constant such that said reflected power is substantially zero.

14. An acceleration device for charged particles comprising:

an acceleration cavity;

a source activatable to generate high frequency power;

transmitting means for transmitting said high frequency power from said source to said cavity so as to generate cavity power for controlling energy of said charged particles, said transmitting means being coupled to said cavity in dependence on an area of said transmitting means and a field strength; there being a magnetic coupling constant between said high frequency power and said cavity power; and control means for controlling said transmitting means so as to control said magnetic coupling constant, said control means being arranged to vary field strength, thereby to vary said coupling of said transmitting means to said cavity.

15. An acceleration device for charged particles; comprising:

an acceleration cavity;

a source activatable to generate high frequency power;

transmitting means for transmitting said high frequency power from said source to said cavity so as to generate cavity power for controlling the energy of said charged particles, said transmitting means also being capable of generating reflected power; and control means for controlling said transmitting means so as to control said reflected power, said control means being arranged to act during the existance of said charged particles in said cavity.

16. An acceleration device for charged particles, comprising:

an acceleration cavity;

a source for generating high frequency power;

transmitting means for transmitting said high frequency power from said source to said cavity said transmitting means being magnetically coupled to said cavity in dependence on an area of said transmitting means and a field strength/permeability relation of the coupling; and means for varying said field strength/permeability relation so as to vary the magnetic coupling of said transmitting means to said cavity.

17. An acceleration device for charged particles, comprising:

an acceleration cavity;

a source for generating high frequency power;

transmitting means for transmitting said high frequency power from said source to said cavity, said transmitting means being magnetically coupled to said cavity;

bias means for applying a bias to said magnetic coupling of said transmitting means to said cavity in dependence on a bias current; and current control means for controlling said bias current so as to control said magnetic coupling of said transmitting means to said cavity.

18. An acceleration device for charged particles, comprising:

an acceleration cavity;

a source for generating high frequency power;

transmitting means for transmitting said high frequency power from said source to said cavity so as to generate cavity power in said cavity for controlling the energy of said charged particles;

bias means for applying a bias to said cavity in dependence on a bias current; and current control means for controlling said bias current so as to control detuning between the oscillation frequency of said high frequency power source and the resonance frequency of said cavity power.

19. A device according to claim 18, wherein said bias means comprises at least one magnetic body and at least one coil for causing said at least one magnetic body to generate a bias magnetic field arranged to act on said transmitting means.

20. A power coupler for an acceleration device for charged particles, comprising:

transmitting means for transmitting high frequency power;

bias means for controlling said transmitting means, said bias means having means for generating a bias magnetic field, said bias magnetic field being arranged to act on said transmitting means so as to influence the transmission of said high frequency power from said transmitting means; and a bias control means for controlling said bias means so as to control said bias magnetic field and thereby control said transmission of said high frequency power.

21. A power coupler according to claim 20, wherein said bias means comprises at least one magnetic body and at least one coil for causing said at least one magnetic body to generate a bias magnetic field arranged to act on said transmitting means.

22. An acceleration device for charged particles, comprising:

an acceleration cavity;

means for applying high frequency power to said cavity so as to generate cavity power in said cavity for controlling the energy of said charged particles, said cavity power causing a field in said cavity; and control means for controlling detuning of the oscillation frequency of said high frequency power source and for controlling the resonance frequency of said cavity power;

wherein said control means includes at least one looped conductor in said cavity for coupling with said field in said cavity and extracting power from said field, and means for controlling the extraction of power from said field by said at least one looped conductor.

23. An acceleration device according to claim 22, wherein said at least one looped conductor is hollow.

24. An acceleration device according to claim 22, further including means for detecting said detuning of said acceleration power relative to said high frequency power, and generating an output to said detuning controller.

25. An acceleration device according to claim 22, wherein said means for controlling the extraction of power from said field comprises a magnetic body for influencing said coupling of said at least one looped conductor with said field; and means for controlling the specific magnetic permeability of said magnetic body thereby to change the influence of said magnetic body on said at least one looped conductor.

26. A detuning controller for controlling density of an acceleration device for charged particles, comprising:

at least one looped conductor for coupling with a field so as to extract power from said field;

a magnetic body for influencing said coupling of said at least one looped conductor with said field; and means for controlling the specific magnetic permeability of said magnetic body, thereby to change the influence of said magnetic body on said at least one looped conductor.

27. A detuning controller according to claim 26, wherein said at least one looped conductor is hollow.

28. A ring type accelerator system comprising a plurality of magnets defining a looped path for a beam of charged particles, and at least one acceleration device in said looped path for controlling energy of said beam;

said acceleration device comprising:

an acceleration cavity;

a source activatable to generate high frequency power;

transmitting means for transmitting said high frequency power from said source to said cavity so as to generate cavity power for controlling energy of said charged particles, there being a magnetic coupling constant between said high frequency power and said acceleration power; and control means for controlling said transmitting means so as to control said magnetic coupling constant, said control means being arranged to act during a circulatory motion of said charged particles.

29. A ring type accelerator system comprising a plurality of magnets defining a looped path for a beam of charged particles, and at least one acceleration device in said looped path for accelerating said beam;

said acceleration device comprising:

an acceleration cavity;

a source activatable to generate high frequency power;

transmitting means for transmitting said high frequency power from said source to said cavity so as to generate acceleration power for accelerating said charged particles, said transmitting means also being capable of generating reflected power; and control means for controlling said transmitting means so as to control said reflected power, said control means being arranged to act during activation of said power source.

30. A ring type accelerator system comprising a plurality of magnets defining a looped path for a beam of charged particles, and at least one acceleration device in said looped path for controlling energy of said beam; said acceleration device comprising:

an acceleration cavity;

a source for generating high frequency power;

transmitting means for transmitting said high frequency power from said source to said cavity, said transmitting means being magnetically coupled to said cavity in dependence on an area of said transmitting means and a field strength/permeability relation of the coupling; and means for varying said field strength/permeability relation so as to vary the magnetic coupling of said transmitting means to said cavity.

31. A ring type accelerator system comprising a plurality of magnets defining a looped path for a beam of charged particles, and at least one acceleration device in said looped path for controlling energy of said beam; said acceleration device comprising:

an acceleration cavity;

a source for generating high frequency power;

transmitting means for transmitting said high frequency power from said source to said cavity, said transmitting means being magnetically coupled to said cavity;

bias means for applying a bias to said magnetic coupling of said transmitting means to said cavity in dependence on a bias current; and current control means for controlling said bias current so as to control said magnetic coupling of said transmitting means to said cavity.

32. A ring type accelerator system comprising a plurality of magnets defining a looped path for a beam of charged particles, and at least one acceleration device in said looped path for controlling said beam; said acceleration device comprising:

an acceleration cavity;

a source for generating high frequency power;

transmitting means for transmitting said high frequency power from said source to said cavity so as to generate cavity power in said cavity for controlling said beam;

bias means for applying a bias to said cavity in dependence on a bias current; and current control means for controlling said bias current so as to control detuning of the oscillation frequency of the high frequency power source and the resonance frequency of said cavity.

33. A ring type accelerator system comprising a plurality of magnets defining a looped path for a beam of charged particles, and at least one acceleration device in said looped path for controlling said beam; said acceleration device comprising:

an acceleration cavity;

means for applying high frequency power to said cavity so as to generate cavity power in said cavity for controlling said charged particles, said cavity power causing a field in said cavity; and control means for controlling detuning of the oscillation frequency of high frequency power source and the resonance frequency of said cavity;

wherein said control means includes at least one looped conductor in said cavity for coupling with said field in said cavity and extracting power from said field, and means for controlling the extraction of power from said field by said at least one looped conductor.

34. A method of controlling synchrotron acceleration of a beam of charged particles using an acceleration device; comprising:

applying high frequency power to said acceleration device so as to accelerate said beam;

controlling the detuning of the high frequency power to the beam; and controlling the coupling constant of the high frequency power to the beam;

wherein each of said control of detuning and said control of the coupling constant are simultaneous with the application of said high frequency power.

35. A method of controlling a ring-type accelerator system, comprising the steps of:

injecting charged particles into said system to form a beam of said charged particles;

repeating said injection step a plurality of times thereby to increase in a plurality of steps the number of said charged particles in said beam; and controlling the detuning defined frequency difference between said high frequency power and accelerating power of said particles during the injection step.

36. A method according to claim 35, wherein said step of controlling said detuning is pre-programmed in advance of said step of injecting charged particles.

37. A method according to claim 35, further comprising the step of detecting said detuning between each said repetition of said injection step, and said step of controlling detuning is carried out in dependence on said detected detuning.

38. A method according to claim 35, wherein the ring-type accelerator system includes a synchrotron ring.

39. A method according to claim 35, wherein the ring-type accelerator system includes an accumulator ring.

40. A method of controlling synchrotron acceleration of a beam of charged particles using an acceleration device comprising:

applying high frequency power to said acceleration device so as to accelerate said beam;

controlling said high frequency power to the beam; and controlling a magnetic coupling constant of said high frequency power to the beam.

41. A method of controlling a ring-type accelerator system, comprising the steps of:

injecting charged particles onto said system to form a beam of said charged particles;

repeating said injection step a plurality of times thereby to increase in plurality of steps the number of said charged particles in said beam; and controlling said high frequency power to the beam during the injection.

42. A method according to claim 41, wherein the ring-type accelerator system includes a synchrotron ring.

43. A method according to claim 41, wherein the ring-type accelerator system includes an accumulator ring.

* * * * *